United States Patent [19]

Hirata

[11] Patent Number: 4,733,027

[45] Date of Patent: Mar. 22, 1988

[54] AUTO-RETURN TYPE PUSH SWITCH

[75] Inventor: Toshihisa Hirata, Furukawa, Japan

[73] Assignee: Alps Electric Co., Ltd., Japan

[21] Appl. No.: 4,968

[22] Filed: Jan. 20, 1987

[30] Foreign Application Priority Data

Mar. 18, 1986 [JP] Japan ..... 61-38285[U]

[51] Int. Cl.[4] ..... H01H 15/02

[52] U.S. Cl. ..... 200/16 D; 200/159 R; 200/340

[58] Field of Search ..... 200/16 R, 16 A, 16 B, 200/16 C, 16 D, 16 E, 16 F, 159 R, 159 A, 314, 340

[56] References Cited

U.S. PATENT DOCUMENTS 1,686,506 10/1928 Anthony ..... 200/159 R 4,473,727 9/1984 Beck ..... 200/16 A 4,488,018 12/1984 Hayashida ..... 200/6 R

*Primary Examiner*—A. D. Pellinen

*Assistant Examiner*—Morris Ginsburg

*Attorney, Agent, or Firm*—Guy W. Shoup

[57] ABSTRACT

An auto-return type push switch is provided with a casing and a cover plate for covering the open face of the casing, and a slide member accommodated movably in the casing which has a lug projecting outside the case through the hole of the cover plate. A pair of fixed electrodes are erected on the bottom surface of the casing, and a clip-shaped movable contact segment accommodated in the cylinder portion of the slide member is contactable with the fixed electrodes. A helical spring is provided between the collar portion of the slide member and the bottom surface of the casing so as to surround the cylinder portion, wherein one contact leaf of the movable contact segment is in contact with one of the fixed electrodes and the other contact leaf with the other of the fixed electrodes.

2 Claims, 4 Drawing Figures

AUTO-RETURN TYPE PUSH SWITCH

BACKGROUND OF THE INVENTION

1. Field of the Invention

This invention relates to the structure of an auto-return type push switch.

2. Description of the Prior Art

FIGS. 3 and 4 are explanatory drawings of a conventional push switch.

In FIG. 4, reference numeral 1 designates a casing made of insulating material, 2 designates a cylindrical hole with a bottom formed in the upper surface of the casing 1, 3 designates a U-shaped groove formed at a portion of the periphery of the cylindrical hole 2, and 4 designates a spring bearing erected on the bottom surface of the casing 1 adjacent to the inner periphery of the cylindrical hole 2. In this spring bearing 4 is embedded a fixed electrode 5, this fixed electrode 5 being led out of the casing 1 via a terminal 6 embedded in the bottom of the casing 1 as shown in FIG. 3. 7 designates a helical spring accommodated in the cylindrical hole 2 with its portion fitted in a gap 8 between the spring bearing 4 and the inner periphery of the cylindrical hole 2, which is configured so that as a lower end portion of the spring 7 is placed on another fixed electrode 9 embedded in the bottom surface of the casing 1 this spring 7 is kept in contact with the fixed electrode 9. 9*a* designates a lead terminal of the fixed electrode 9. 10 designates a slide member, and 11 designates a clip-shaped movable contact segment which is accommodated in a groove 13 formed in a movable contact segment accommodating portion 12 of the slide member 10. This accommodating portion 12 is loosely fitted in the helical spring 7. A colllar 14 provided above the accommodating portion 12 is engaged with an upper end portion of the helical spring 7. 10*a* designates a projection portion provided at a portion of the slide member 10 for guiding the slide member 10 when moving.

One end of the helical spring 7 is fixed to an attaching portion 15 of the movable contact segment 11 through, for example, a welding process, and the movable contact segment 11 is in contact with both surfaces of the fixed electrode 5. 16 designates a cover plate whose upper surface is provided with a collar 17 in relation to the cylindrical hole 2 of the casing 1. A lug 19 of the slide member 10 projects outside the cover plate 16 through a hole 18 formed in the collar 17. The cover plate 16 is secured to the casing 1 by coupling holes 21 formed in attaching legs 20 of the cover plate 16 with projections 22 provided on the external surface of the casing 1.

According to the conventional push switch of the foregoing structure, as the lug 19 being in the non-pushed state of FIG. 3 is pushed downward or toward the bottom of the drawing, the slide member 10 moves down while the projection portion 10*a* is being guided by the groove 3 of the casing 1, and the collar 14 of the slide member 10 compresses the helical spring 7. During the above pushing action the movable contact segment 11 slides on from a non-conductor portion 24 to a conductor portion 25 of the fixed electrode 5, as a result, the fixed electrode 5 comes into conduction with the other fixed electrode 9 via the movable contact segment 11 and the helical spring 7, and the contacts of the switch assume the ON state. If the pushing force is removed, owing to the resiliency of the helical spring 7 the lug 19 returns to its initial non-pushed state shown in FIG. 3.

The foregoing switch, however, has the following problems:

(1) A welding process or a soldering process is necessary to secure one end of the helical spring 7 to the attaching portion 15 of the movable contact segment 11, thus, the efficiency of assembly work is low, (2) The helical spring 7 must have a low resistance because it is used as a part of the contact, thus, the spring 7 must be silver-plated, thereby resulting in a high cost, and (3) Contact between the helical spring 7 and the fixed electrode 9 is realized in a mode of point contact, thus is unstable and gives a large contact resistance.

SUMMARY OF THE INVENTION

It is an object of the present invention to solve the aforementioned problems of the prior art, thus to provide a push switch which is high in efficiency of assembly work, low in cost, and stable in contact in comparison with the conventional one.

To achieve the foregoing object, the present invention provides an auto-return type push switch which comprises a case composed of a casing and a cover plate for covering the open face of the casing, a slide member accommodated movably in the casing which as a lug projecting outside the case through the hole of the cover plate; a cylinder portion; and a collar portion, a pair of fixed electrodes erected on the bottom surface of the casing, a clip-shaped movable contact segment accommodated in the cylinder portion of the slide member which is contactable with the fixed electrodes and a helical spring provided between the collar portion of the slide member and the bottom surface of the casing so as to surround the cylinder portion, wherein one contact leaf of the movable contact segment is in contact with one of the fixed electrodes and the other contact leaf with the other of the fixed electrodes.

According to the present structure as above, as the lug is pushed downward in opposition to the resiliency of the helical spring, the movable contact segment accommodated in the slide member also moves down to slide on from non-conductor portions to conductor portions of the fixed electrodes, so that the two fixed electrodes are short-circuited mutually by means of the movable contact segment to thereby result in the ON state between the switch contacts, whereas as the pushing force is removed, the lug returns to its initial non-pushed state owing to the resiliency of the helical spring to thereby result in the OFF state between the switch contacts.

DESCRIPTION OF THE PREFERRED EMBODIMENT

An embodiment of the present invention will now be described with reference to FIGS. 1 and 2.

Figure 1:
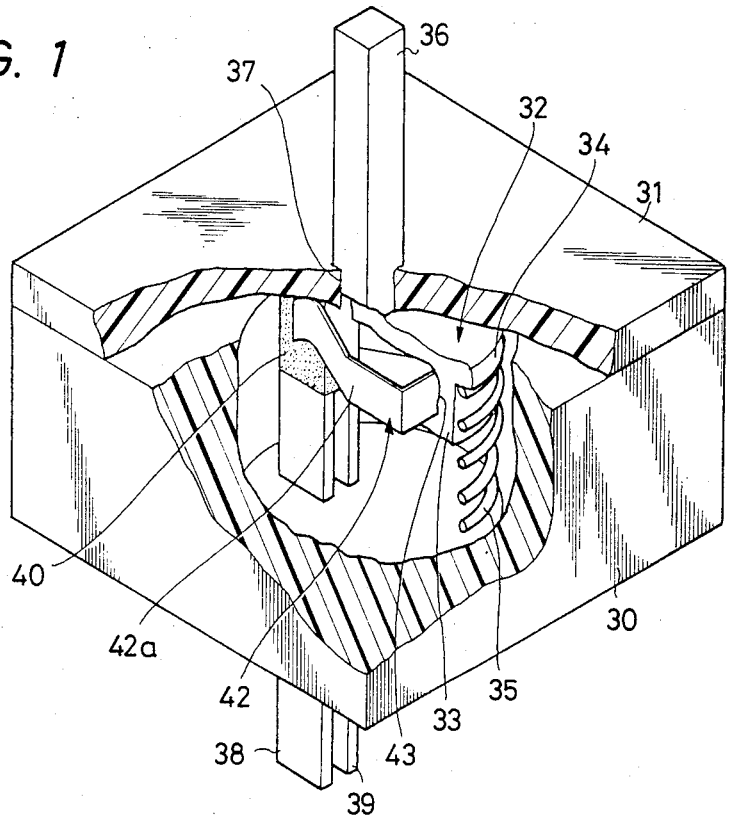
FIG. 1 is a perspective view explanatory of an embodiment of the present invention.

In FIG. 1, reference numeral 30 designates a box-shaped casing made of insulating material, and 31 designates a cover plate for covering the open face of the casing 30, the above two forming a case. 32 designates a slide member having a cylinder portion 33 and a collar portion 34, between the collar portion 34 and the bottom surface of the casing 30 is provided a helical spring 35 so as to surround the cylinder portion 33, and a lug 36 passes through a hole 37 of the cover plate 31 and projects outside the cover plate 31. 38 and 39 designate fixed electrodes of a pair erected on the bottom surface of the casing 30, these electrodes 38 and 39 having non-conductor portions 40 and 41, respectively, formed at a portion of each electrode.

42 designates a clip-shaped movable contact segment which is accommodated in a movable contact segment insertion groove 43 formed in the cylinder portion 33 of the slide member 32. As shown in FIG. 2, one contact leaf 42*a* of the movable contact segment 42 is in contact with one fixed electrode 38 and the other contact leaf 42*b* with the other fixed electrode 39.

Figure 2:
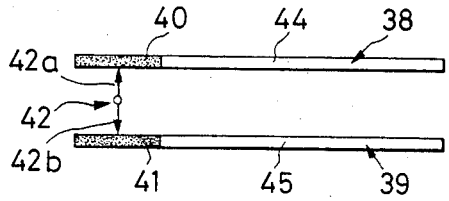
FIG. 2 is a schematic diagram explanatory of a contact section of the embodiment of the present invention.
Figure 3:
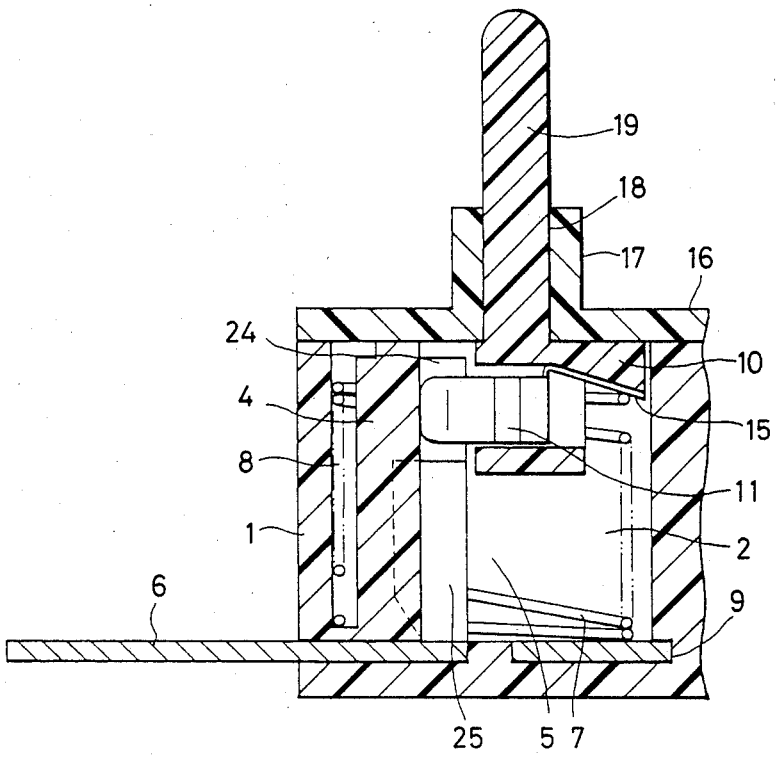
FIG. 3 PRIOR ART
FIG. 3 is a vertical sectional view explanatory of a conventional structure.
Figure 4:
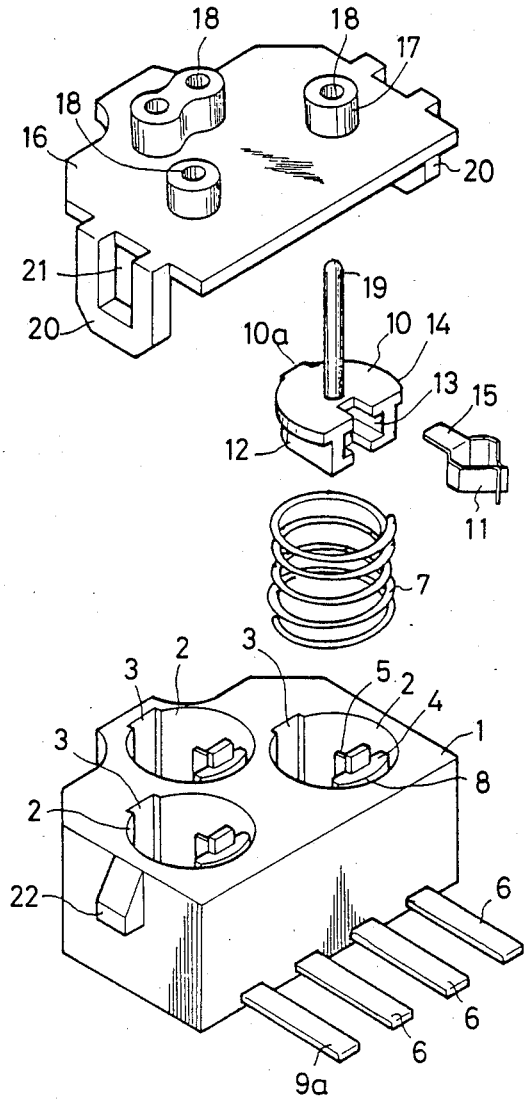
FIG. 4 PRIOR ART
FIG. 4 is an exploded perspective view of the conventional structure.

Since the switch according to the present invention has the foregoing structure, in the non-pushed state of the lug 36, as shown in FIGS. 1 and 2, one contact leaf 42*a* of the movable contact segment 42 is in contact with the non-conductor portion 40 of the fixed electrode 38 and the other contact leaf 42*b* with the non-conductor portion 41 of the fixed electrode 39.

As the lug 36 is pushed in the state above, the slide member 32 moves down while compressing the helical spring 35 by means of the collar portion 34. In response to downward movement of the slide member 32, the movable contact segment 42 also moves down, one contact leaf 42*a* of the movable contact segment 42 comes into contact with a conductor portion 44 of the fixed electrode 38 and the other contact leaf 42*b* with a conductor portion 45 of the fixed electrode 39, so that the two fixed electrodes 38 and 39 conduct with each other via the movable contact segment 42, thereby resulting in the ON state between the switch contacts.

In the thus attained state, as the pushing force is removed, the lug 36 returns to its initial state shown in FIGS. 1 and 2 owing to the resiliency of the helical spring 35, and the OFF state is again restored between the switch contacts.

According to the embodiment of the present invention, (1) A welding process or a soldering process, that is necessary in securing one end of the helical spring 7 to the movable contact segment 11 of the conventional structure, can be eliminated, thus, the working efficiency is enhanced in comparison with the prior art, (2) The helical spring 35 is not used as the contact and silver-plating is not required for the spring 35, thus, the manufacturing cost is lowered in comparison with the prior art, and (3) The helical spring 35 is not used as the contact, thus, it is not necessary to worry about instability of contact, an increase of contact resistance, and the like which would be caused by the spring 35 of the prior art serving as a part of the contact.

According to the present invention, one pair of fixed electrodes is erected on the bottom surface of the casing, the movable contact segment is accommodated in the slide member, one contact leaf of the movable contact segment is kept in contact with one fixed electrode and the other contact leaf with the other fixed electrode, the two fixed electrodes are switched between the conducting state and the non-conducting state by means of the clip-shaped movable contact segment to thereby result in the ON/OFF state between the switch contacts, but, the helical spring is not used as any part of the contact different from the prior art, thus, the present invention has the effect that the efficiency of assembly work can be enhanced, and instability of contact and an increase of contact resistance can be avoided.

What is claimed is:

1. An auto-return type push switch comprising a case composed of an open casing and a cover plate for covering the open face of said casing, a slide member accomodated movably in said casing which has a lug projecting outside said case through a hole in said cover plate, a cylinder portion, and a collar portion, a pair of fixed electrodes disposed side by side in parallel erected on a bottom surface of said casing, each of said electrodes having a non-conductor portion and a conductor portion for providing the ON/OFF state of the swtich, a clip-shaped movable contact segment accomodated in said cylinder portion of said slide member which is contactable with said fixed electrodes, and a helical spring provided between said collar portion of said slide member and the bottom surface of said casing so as to surround said cylinder portion, wherein one contact leaf of said movable contact segment is in sliding contact with one of said fixed electrodes and the other contact leaf with the other of said fixed electrodes.

2. An auto-return type push switch according to claim 1, wherein said helical spring is compressed when said lug is pushed into said case and returns said lug to its initial position when a pushing force is removed.

* * * * *